US008011521B2

(12) United States Patent
Clark

(10) Patent No.: US 8,011,521 B2
(45) Date of Patent: Sep. 6, 2011

(54) FLUID CONTAINER

(75) Inventor: Timothy A. Clark, Durham, OR (US)

(73) Assignee: NIKE, Inc., Beaverton, OR (US)

( * ) Notice: Subject to any disclaimer, the term of this patent is extended or adjusted under 35 U.S.C. 154(b) by 622 days.

(21) Appl. No.: 11/972,413

(22) Filed: Jan. 10, 2008

(65) Prior Publication Data

US 2009/0178997 A1 Jul. 16, 2009

(51) Int. Cl.
*A61J 9/00* (2006.01)

(52) U.S. Cl. ..... 215/11.1; 215/11.6; 215/384

(58) Field of Classification Search ..... 215/11.1, 215/384, 11.6
See application file for complete search history.

(56) References Cited

U.S. PATENT DOCUMENTS

| | | | | | |
|---|---|---|---|---|---|
| 569,304 | A | * | 10/1896 | Paquette | 137/605 |
| 3,145,867 | A | * | 8/1964 | Roberts et al. | 215/11.1 |
| D226,688 | S | | 4/1973 | Thornton | |
| D234,940 | S | | 4/1975 | Mezquita | |
| D260,734 | S | | 9/1981 | Frumin et al. | |
| D280,601 | S | | 9/1985 | Biesecker | |
| 4,600,111 | A | * | 7/1986 | Brown | 215/6 |
| D298,354 | S | * | 11/1988 | Viator | D24/197 |
| D301,741 | S | * | 6/1989 | Barber | D24/197 |
| D308,330 | S | | 6/1990 | Teece | |
| 5,094,363 | A | * | 3/1992 | Monahan et al. | 222/131 |
| 5,114,374 | A | * | 5/1992 | Estiva | 446/77 |
| 5,117,993 | A | | 6/1992 | Vesborg | |
| 5,178,308 | A | | 1/1993 | Endre | |
| 5,285,933 | A | * | 2/1994 | Gentes et al. | 222/148 |
| 5,597,087 | A | | 1/1997 | Vinarsky | |
| D382,969 | S | * | 8/1997 | Giles et al. | D24/197 |
| D390,785 | S | | 2/1998 | Saunders et al. | |
| D398,853 | S | | 9/1998 | Phillips | |
| D428,496 | S | | 7/2000 | Thom et al. | |
| D432,918 | S | | 10/2000 | Aftoora | |
| D433,066 | S | * | 10/2000 | Porter | D19/90 |
| 6,173,850 | B1 | * | 1/2001 | Scheetz et al. | 215/11.1 |
| D440,317 | S | * | 4/2001 | Tollman | D24/197 |
| D448,998 | S | | 10/2001 | Farris | |
| D462,449 | S | | 9/2002 | Morano | |
| D464,434 | S | | 10/2002 | Morano | |
| D475,626 | S | | 6/2003 | Barruw | |
| 6,604,642 | B1 | | 8/2003 | Barruw | |
| D482,620 | S | | 11/2003 | Kleckauskas et al. | |
| D483,268 | S | | 12/2003 | Willows et al. | |
| D491,018 | S | | 6/2004 | Vinarsky | |
| D512,875 | S | | 12/2005 | Maldonado | |
| 6,971,562 | B2 | | 12/2005 | Willows et al. | |
| D514,451 | S | | 2/2006 | Weltgen et al. | |
| D524,657 | S | | 7/2006 | Harris et al. | |
| 7,100,782 | B2 | | 9/2006 | Hanna | |

(Continued)

*Primary Examiner* — Tri Mai
(74) *Attorney, Agent, or Firm* — Banner & Witcoff, Ltd.

(57) ABSTRACT

A fluid container may include a body, a grip element, a cap, and a nozzle. The fluid container may be capable of containing and dispensing fluid, such as water. The body may contain the fluid and the grip element may be shaped for a user's hand. The cap may be attachable to the body and may be tapered as it extends away from the body. The grip element may provide a user with traction and gripping ability. The cap may be attachable to the body and may be detached to expose an opening through which the body may be filled with fluid. The nozzle may be capable of selectively dispensing fluid. The fluid container may be a sports water bottle shaped to fittingly engage a user's hand. The sports water bottle may be portable and may be used during such activities as athletics and travel.

17 Claims, 3 Drawing Sheets

U.S. PATENT DOCUMENTS

| | | | | |
|---|---|---|---|---|
| D557,610 | S * | 12/2007 | Conway | D9/543 |
| 7,326,234 | B2 * | 2/2008 | Lieberman et al. | 606/236 |
| 7,328,788 | B2 * | 2/2008 | Mahieu et al. | 206/5.1 |
| 2003/0141268 | A1 * | 7/2003 | Kerns et al. | 215/11.1 |
| 2005/0035078 | A1 * | 2/2005 | Lieberman et al. | 215/11.1 |
| 2005/0189314 | A1 * | 9/2005 | Carbone | 215/396 |
| 2005/0258201 | A1 | 11/2005 | Willows et al. | |
| 2006/0011676 | A1 | 1/2006 | Willows et al. | |
| 2006/0071040 | A1 | 4/2006 | Young et al. | |
| 2006/0201902 | A1 | 9/2006 | Brown et al. | |
| 2006/0213858 | A1 * | 9/2006 | Kraus et al. | 215/11.1 |
| 2006/0273059 | A1 * | 12/2006 | Mendenhall et al. | 215/11.1 |
| 2007/0007226 | A1 | 1/2007 | Kerner et al. | |
| 2007/0023460 | A1 | 2/2007 | Ochen Diehl | |

* cited by examiner

FLUID CONTAINER

FIELD OF THE INVENTION

Aspects of the invention relate generally to containers for storing fluid. More specifically, aspects of the invention relate to bottles shaped to dispense water or other liquids to users in a convenient and comfortable fashion, e.g., while the user is working out or participating in an athletic activity.

BACKGROUND

Many people use fluid containers for containing fluid and for dispensing fluid upon command. Further, fluid containers have become portable and have been configured for use during athletic activities and travel. Some fluid containers, such as water bottles, have been equipped with nozzles that selectively dispense water contained in the body of the water bottle in a controlled fashion. The nozzle usually has a cap or closure configured to retain the water with the water bottle. Some water bottles also have a grip portion that is positioned around the body of the water bottle to provide the user with greater gripping capabilities.

Many fluid containers, such as water bottles, have nozzles attached to a cap that serve as the outlet of the stored fluid attached to the body of the water bottle. The nozzles are usually positioned in the center of the cap and are angled to extend away from the cap in a 90° angle which forces the user to rotate the water bottle up to or more than 180° to dispense the water. Further, many of the water bottles have a cylindrical shape that does not lend itself to reliable gripping of the body of the water bottle, which may cause discomfort or awkward motions during use or may result in the user dropping the bottle. Therefore, a fluid dispensing bottle that overcomes some or all of these disadvantages would be a welcomed advance in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to a fluid container comprising a body, a grip element, a cap, and a nozzle for dispensing fluid. The body may define a space for storing fluid and may have a first end, a second end, a neck region, and a side wall. The side wall may extend between the first end and the second end. The grip element may be attachable to or integrally formed with the body and may extend around at least a portion of the side wall of the body. The cap may have an exterior surface and may be attachable to the first end of the body. The nozzle may be attached to the cap and may be positioned asymmetrically on the exterior surface of the cap.

In another aspect, the invention may comprise a water bottle having a body for containing fluid, a traction element, a grip, a cap, and a nozzle attached to the cap. The body may have a top wall, a bottom wall, and a side wall. The body may also have a neck region, a grip region, and a container region. The traction element may be defined in the side wall of the body. The grip may extend around at least a portion of the body and may extend over at least a portion of the traction element. The cap may be attachable to the body and the nozzle may be attached to the cap. The nozzle may be positioned asymmetrically on the cap so that the nozzle is offset from a center of the cap. The nozzle may be positioned at an angle that causes the nozzle to extend toward a user.

In yet another aspect, the invention may include a container for dispensing fluid comprising a body for containing fluid, a tapered cap, and a nozzle. The body may include a grip, a traction element, and a cavity. The tapered cap may be attachable to the body and may be angled away from the container and toward a user. The nozzle may be positioned asymmetrically between a first edge and a second edge of the tapered cap.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

Figure 1:
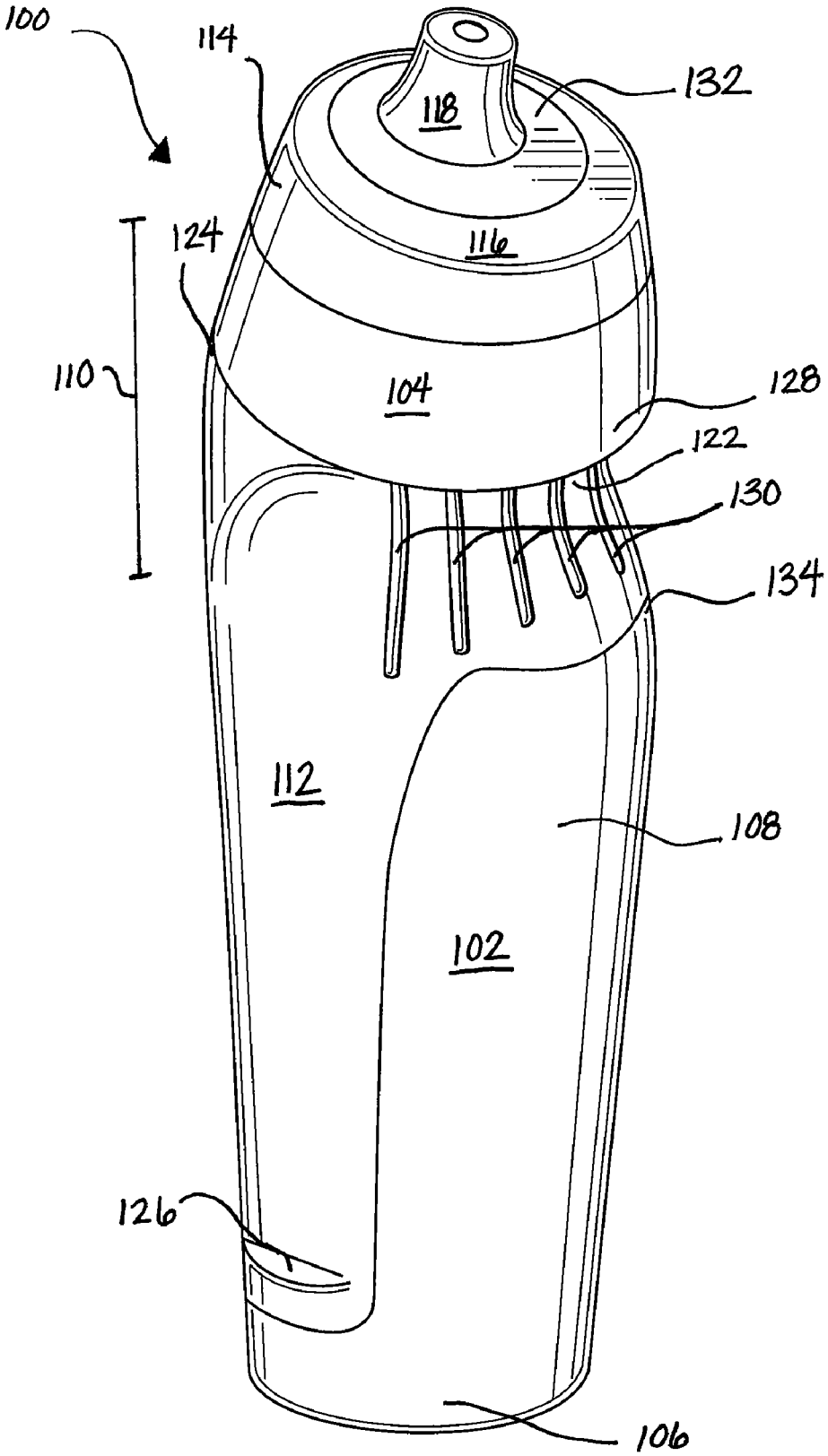
FIG. 1 illustrates a perspective view of a fluid container, in accordance with an aspect of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

The various figures in this application illustrate examples of fluid containers according to this invention. When the same reference number appears in more than one drawing, that reference number is used consistently in this specification and the drawings to refer to the same or similar parts throughout.

In general, as described above, aspects of the invention relate to fluid containers, as illustrated in FIGS. 1-4. In accordance with at least some aspects of the invention, a fluid container 100 includes a body 102, a grip element 112, a cap 114, and a nozzle 118. The fluid container 100 may be any suitable container such as a water bottle, a coffee or other hot liquid mug, a travel container, or the like. The fluid container 100 may include any suitable material such as polymers/plastics materials. The fluid container 100 may be formed from a single material or a plurality of materials. Each element of the fluid container 100 may be made from the same material or from a plurality of materials. For example, the body 102 of the fluid container 100 may include a flexible polymeric material that allows the fluid container to be squeezed to assist during dispensing the fluid.

Figure 5:
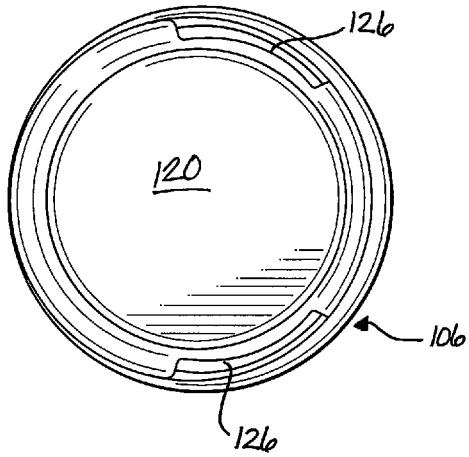
FIG. 5 illustrates a top plan view, according to an aspect of the invention.

The body 102 may define a space (not shown) for storing fluid and may have a first end 104, a second end 106, and a neck region 110. The body 102 may also have a side wall 108 (or group of side walls) that extends between the first end 104 and the second end 106. The space for storing fluid may be any suitable shape including, but not limited to, a cylinder, a sphere, a cube, or the like. As illustrated in FIG. 5, the space for storing fluid may have a flat surface 120 at or near the second end 106 of the body 102 to allow the fluid container 100 to stand upright when positioned on a surface such as a table, counter, chair, or the like. In some examples, the side wall of a generally cylindrically shaped body 102 may be of uniform grade with respect to the first end 104 or the top wall and second end 106 or the bottom wall. In other examples, the side walls 108 may be of non-uniform shape, such as ergonomic designs that compliment a grip of a user's hand during use of the bottle.

The space for storing fluids may have an interior surface and an exterior surface. Either or both of the interior surface and the exterior surface may include a thermo-protective layer of material that helps to maintain the fluid's temperature, such as a metal, ceramic, polymeric, rubber, glass, and/or wood material. For example, the material or materials may have properties that protect the temperature of fluids stored within the bottle. Such properties may maintain fluids at a cool or a warm temperature, or any other temperature desired by the user. The first end 104, a second end 106, and the side wall 108 may each include different materials or the same materials. Any suitable number of layers may be included in the body 102 and any suitable type of material may be used for each layer without departing from this invention.

As noted above, the body 102 may define a space for storing fluids such as liquids and gases. In some examples, the fluids may be beverages and may be stored in the body 102. The beverages may be hot or cold and may include water, beverages designed to hydrate a user's body during athletic activities or exercise, or the like. Any suitable fluid or combination of fluids may be stored in the fluid container 100.

The body 102 may be formed as a single or multi-piece construction, and as noted above, may include a first end 104, an opposite second end 106, a neck region 110, and a side wall 108 that extends between the first end 104 and the second end 106. The first end 104 may be positioned opposite of the second end 106. Either or both of the first end 104 and the second end 106 may be rounded or have angled or beveled edges and/or may be tapered. One or both of the first end 104 and the second end 106 may define a flat surface 120 for facilitating stability of the fluid container 100 when it is placed on a surface such as a counter, table, or the like.

The side wall 108 that extends from the first end 104 of the body 102 to the second end 106 of the body 102 may be any suitable shape and may be formed of a uniform material or a combination of materials. The side wall 108 may form one or more layers of the body 102. In some examples, the side wall 108 includes an interior and an exterior surface (not shown) where the interior surface comprises a uniform material such as stainless steel and the exterior surface may comprise a uniform polymeric material. Any number of intermediate surfaces or layers may be positioned between the interior surface and the exterior surface.

The side wall 108 may comprise one or more discrete pieces. For example, the side wall 108 may be shaped (in a cross section) as a polygon having four sides. Each of the four sides may be attached to one another to form the polygon. In another example, the side wall 108 may be shaped as a round cylinder (or other shape) created by joining two half-cylindrical pieces or may be formed from a single, uniform piece of material. The side wall 108 may be formed from any suitable number of pieces of material.

The neck region 110 of the body 102 may be positioned closer to the first end 104 rather than the second end 106 of the body 102. The neck region 110 may be shaped to receive a user's hand during use. For example, the neck region 110 may be tapered or otherwise appropriately shaped so as to form a cavity 122 for receiving the user's hand or for providing traction during use. The cavity 122 may be shaped and/or sized in any form for any user and may be adjusted so that it may be positioned in any suitable location along the length of the side wall 108 of the body 102.

The neck region 110 of the body 102 may form an angle 124 between the body 102 and the cap 114. In some examples, the angle 124 is greater than 90°, although the angle 124 may be any suitable or desired size. The angle 124 may be located away from the grip cavity and it may b arranged and oriented so as to cause the neck region 110 to direct the cap 114 and nozzle 118 toward a user and toward a side of the neck region 102 that includes the grip cavity 122. For example, the angle 124 may be about 120° and may direct the nozzle 118 toward a user so that the user may dispense fluid from the fluid container 100 without rotating the body 102 of the fluid container 100 greater than 90°. Because of the angle 124 in the neck region 110 of the body 102, the fluid may be dispensed with little effort and may ease the burden on a user attempting to dispense fluid from the fluid container 100.

The angle 124 positioned within the neck region 110 and opposite the cavity 122 may cause the cap 114 to extend away from the body 102 of the fluid container 100 at any suitable or desired. In some examples, the angle 124 may be greater than 90° and may be within a range of between 110°-170°. The angle 124 may facilitate easy dispensing of the fluid when the fluid container 100 is rotated because it allows the fluid to flow easily from the space defined within the body 102 that stores the fluid.

The body 102 may be shaped to form one or more indentations 126 within the side wall 108 of the body 102 (to thereby form a ledge-like structure in the side wall 108 of the body 102). The indentations 126 may help to allow a machine to grip the fluid container 100, such as during manufacture. The indentations 126 may be formed as a cut out of the side wall 108 and form a rim in the lower portion of the body 102. An indentation 126 may extend along a portion of or the entire length of the side wall 108 and may increase gripping characteristics of the side wall 108 for the user. The indentations 126 may be lined with a rubber material or other suitable traction material for creating an easy grip of the fluid container 100 by the user. In some examples, two indentations 126 may be positioned opposite on another along the side wall 108 of the body 102. Any suitable number of indentations 126 may be included in the side wall 108 or other portions of the fluid container 100.

The cavity 122 may be defined by a lip 128 and a knob 134 that may be formed in the neck region 110. In some examples, the neck region 110 may be tapered and thus the lip 128 and the knob 134 may also be tapered. The lip 128 may help to define at least one side of the cavity 122 and may help provide gripping characteristics in the body 102 of the fluid container 100. The lip 128 may protrude away from the deepest part of the cavity 122 and may be positioned adjacent to and/or within the neck region 110 of the body 102. The lip 128 may be positioned closer to the cap 114 and the first end 104 than the cavity 122 and the knob 134. Additionally, the cavity 122 may be positioned closer to the lip 128 and the first end 104 than the knob 134. The cavity 122, the lip 128, and the knob 134 may form a grip or handle that may help provide gripping characteristics of the bottle during use.

The lip 128 may also protrude over the cavity 122 and may be positioned opposite of the angle 124 within the neck region 110. The angle 124 may cause the cap 114 to be positioned so that the nozzle 118 faces or extends toward a user during use. The angle 124 may extend in any suitable or desired direction and a user may wish to utilize the fluid container 100 in any desirable manner, such as positioning the cap 114 to extend toward the user and/or away from the user during use.

The fluid container 100 may also contain a grip element 112 that may be attachable to and/or integrally formed as part of the body 102. The grip element 112 may extend around at least a portion of the body 102. For example, the body 102 may be generally cylindrically shaped and the grip element 112 may extend around the entire perimeter of the body 102, or it may extend around only a portion of the perimeter of the body 102. Further, the grip element 112 may extend along at least a portion of the length of the side wall 108 in a direction from the first end 104 toward the second end 106.

The grip element 112 may extend around the body 102 to varying portions of the perimeter along the length of the body 102. For example, the grip element 112 may extend along the length of the body 102 within the neck region 110 and near the second end 106 of the body 102. Within the neck region 110, the grip element 112 may extend wholly around the perimeter of the body 102. The grip element 112 may extend around a tapering portion of the body 102 as it extends along the length of the body 102 toward the second end 106 of the body 102. For example, the grip element 112 may extend around a first portion of the perimeter of the body 102 near the neck region 110 and around a second portion of the perimeter of the body 102 near the center of the body 102 and/or toward the second end 106 of the body 102, where the second perimeter is less than the first perimeter.

Additionally, the grip element 112 may include one or more contiguous or non-contiguous portions (e.g., as one moves around a perimeter of the body 102). A first portion of the grip element 112 may have a first texture with a first traction characteristic and a second portion of the grip element 112 may have a second texture with a second traction characteristic that is different from the first traction. The grip element 112 may include any desired portions of differing texture or physical characteristics. The grip element 112 may be detachable from the fluid container 100 or may be permanently attached to the fluid container 100.

For example, the grip element 112 may include a traction element (not shown) such as a relatively soft rubber that helps to create friction between the grip element 112 and the user's hand. The grip element 112 may be any suitable or desired shape, such as U-shaped (i.e., surrounding the perimeter of the body 102 of the fluid container 100). In another example, the grip element 112 may include a series of ribs 130 that protrude away from the body 102 of the fluid container. The ribs 130 may help to provide traction for a user when gripping the fluid container. As yet another example, if desired, the ribs 130 may be replaced by similarly-shaped grooves or other discontinuities. Texturing and/or any other desired grip enhancing structures may be provided with grip element 112 without departing from this invention.

The grip element 112 may be formed from a material that is separate from the container body 102. The grip element 112 may include a material or plurality of materials that is the same or different from the material included in the body 102 or any other element of the fluid container 102. The grip element 112 may be integrally formed as part of the body 102 or may be formed of a separately formed piece of material. In some examples, the grip element 112 may be attached or attachable to the body 102 and may be secured to the body 102 by any known method of attachment, such as cements or adhesives, mechanical connectors, or the like.

A series of ribs 130 may be defined within the neck region and may extend along the side wall 108 of the fluid container 100. Further, the ribs 130 may extend through the cavity 122 and into the knob 134. The ribs 130 may serve as a traction element within the neck region 110. Any suitable traction element may be used and may be positioned within the neck region 110 or any other region of the fluid container 100.

The fluid container 100 may contain a cap 114 that may be attachable to the first end 104 of the body 102. The cap 114 may be attached to the first end 104 of the body 102 in any suitable fashion such as by a threaded arrangement, a friction fit, tongue and groove, and/or other retaining structures. The cap 114 may be detached from the body 102 to expose an opening that provides access to the interior space defined within the body 102. The cap 114 may be omitted and a filling port (not shown) may be provided for filling and emptying the fluid container 100 with fluid. In some examples, the nozzle 118 may be configured to be openable and removable, e.g., for purposes of filling and emptying the fluid container 100 with fluid.

Figure 2:
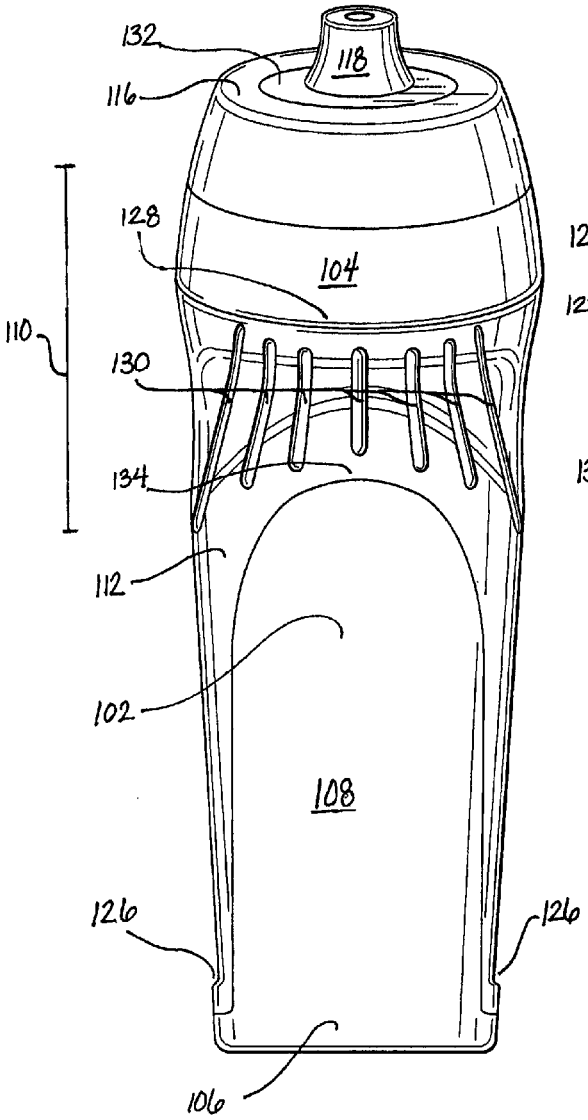
FIG. 2 illustrates a side plan view of the fluid container, according to an aspect of the invention.
Figure 3:
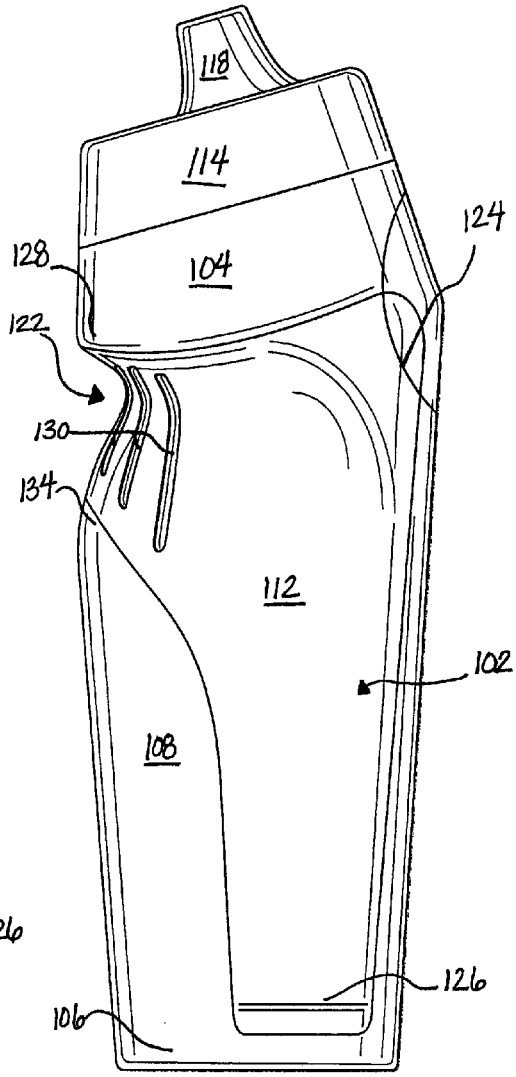
FIG. 3 illustrates another side plan view of the fluid container, according to an aspect of the invention.
Figure 4:
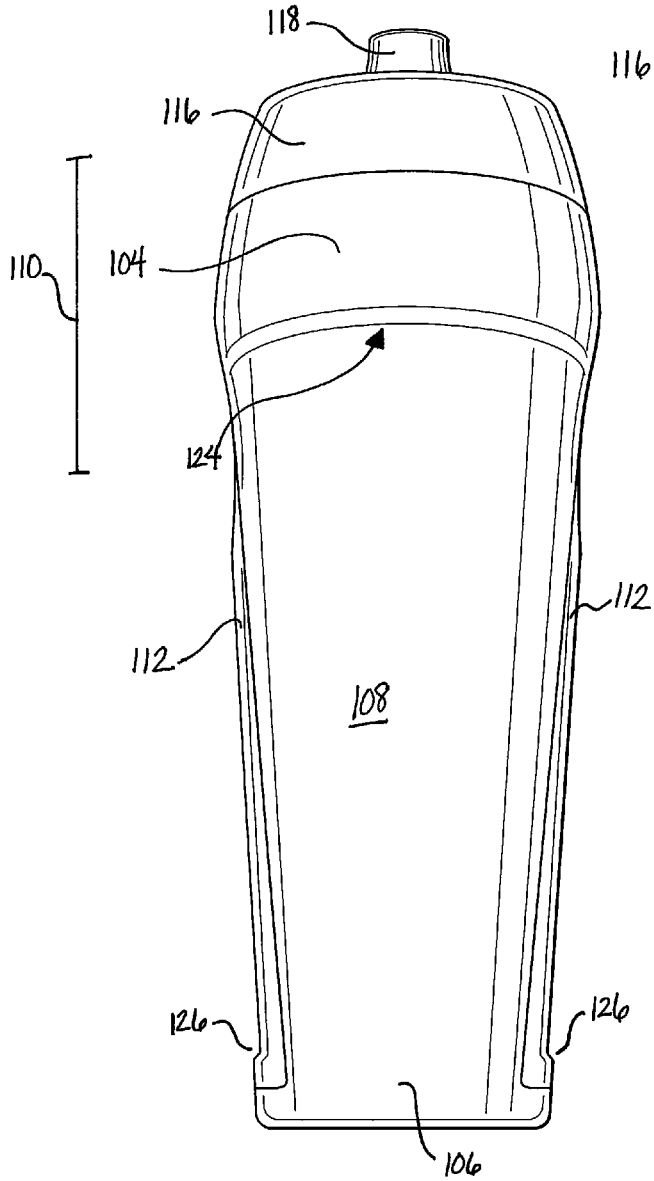
FIG. 4 illustrates yet another side plan view of the fluid container, in accordance with an aspect of the invention.

When attached to the body 102, the cap 114 may create a seal that may be partially or wholly impermeable to fluids or liquids. In other examples, the cap 114 may be integrally formed with the body 102. The nozzle 118 may be integrally formed with the cap 114, as seen in FIG. 3, or may be made of a separate element, as seen in FIG. 2. The nozzle 118 may be capped, covered, or otherwise sealed in any suitable manner, to prevent leakage of fluid from the nozzle 118 when dispensing fluid is not desired.

The cap 114 may have an exterior and an interior surface. The cap 114 may be ergonomically shaped to provide a user with comfort during use. A cap grip 132 may be attached to the exterior surface 116 of the cap 114, in some examples. In some examples, the cap grip 132 may be positioned to surround the nozzle 118 and/or may be positioned to cover a significant portion of the cap 114. The cap grip 132 may be made of any suitable material including foam, rubber, polymers, and the like. The cap grip 132 may include a traction element or may be made from or include a traction enhancing element, such as rubber. The cap grip 132 may fittingly engage with the cap 114 so that it may be selectively attached to the exterior surface of the cap 114. Further, the cap 114 may be tapered so as to become smaller as it extends away from the body 102 of the fluid container 100, as illustrated in FIGS. 1-4.

A nozzle 118 for dispensing fluid may be attached to or integrally formed as part of the cap 114. The nozzle 118 may direct a flow of fluid as it is being selectively dispensed from the body 102 of the fluid container 100. If desired, the nozzle 118 may be alternated between an open position and a closed position. A nozzle 118 in the open position may permit fluid stored within the body 102 of the fluid container to be dispensed, while the nozzle 118 in the closed position may prevent fluid and/or liquids from being dispensed from the body 102 of the fluid container 100. Alternatively, if desired, the nozzle 118 may be static or permanently mounted with respect to the cap 114.

The nozzle 118 may be tapered as it extends away from the cap 114 and the body 102. The nozzle 118 may have a first portion and a second portion of the nozzle surface. The first portion and the second portion may taper at varying degrees to cause the nozzle 118 to taper away from the cap 114 at an angle. In some examples, the nozzle angle may match or substantially match angel 124.

Figure 6:
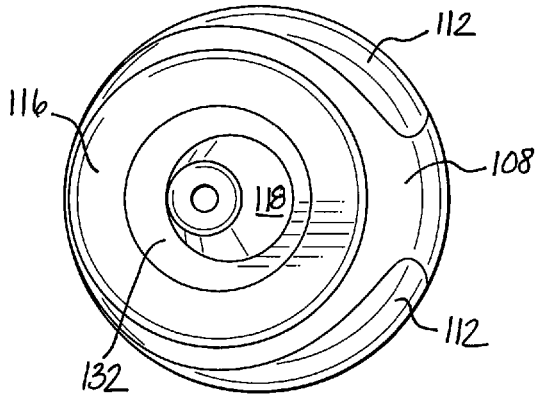
FIG. 6 illustrates a bottom plan view, according to an aspect of the invention.

The nozzle 118 may be positioned at any suitable position on the exterior surface 116 of the cap 114. In some examples, the nozzle 118 may be positioned asymmetrically on the exterior surface 116, offset from a center point (not shown) of the exterior surface 116 of the cap 114, as illustrated in FIG. 6. The center point may be the center of the surface area of the cap 114. The nozzle 118 may be tapered with respect to the cap 114 so that it may extend toward the user during use. The nozzle 118 may taper as it extends away form the exterior surface 116 of the cap 114 in a uniform or non-uniform grading.

The body 102 of the fluid container 100 may also contain a first indentation 126 and a second indentation 126 opposite the first indentation 126. The first and the second indentation 126 may be positioned to provide gripping characteristics for a user during use on either side of the fluid container 100. The first and the second indentations 126 may help to secure a user's grip of the fluid container 100.

C. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A fluid container, comprising:

a body defining a space for storing fluid, the body having a first end, a second end at least one side wall extending between the first end and the second end, a neck region forming a bend in the side wall such that the first end of the body extends in a first axial direction and the second end of the body extends in a second axial direction, a lip on the body, a knob on the body, and a cavity formed in the neck region only and defined by the lip and the knob, the remainder of the body proximate the neck region being free of cavities, the lip and the cavity extend only partially around the bottle, wherein the first axial direction is angled with respect to the second axial direction;

a traction element in the neck region;

a grip element attached to the body, having a texture different than a texture of the body, extending around at least a portion of the side wall of the body, and extending over the traction element;

a cap having an exterior surface, the cap attachable to the first end of the body; and a nozzle for dispensing fluid, the nozzle attached to or integrally formed with the cap and positioned asymmetrically on the exterior surface of the cap.

2. The container of claim 1, further comprising a cap grip fittingly engaged with the cap.

3. The container of claim 1, where the angle between the first axial direction and the second axial direction is greater than 90°.

4. The container of claim 1, where the angle causes the cap to extend toward a side of the neck region that includes the cavity.

5. The container of claim 1, where the body is shaped to form a cavity in the neck region.

6. The container of claim 5, where the cavity includes a lip and a knob positioned in the neck region.

7. The container of claim 1, where the cap is tapered and the nozzle extends and away from the body and toward a side of the neck region that includes a cavity.

8. The container of claim 1, where the grip element includes rubber.

9. The container of claim 1, where the body further includes a first indentation and a second indentation opposite the first indentation.

10. A bottle, comprising:

a body for containing fluid, the body having a first end, a second end, and a side wall, the body also having a neck region, a grip region, a lip on the body, a knob on the body, a cavity formed in the neck region only and defined by the lip and the knob, the remainder of the body proximate the neck region being free of cavities, the lip and the cavity extend only partially around the bottle, and a container region;

a traction element in the neck region;

a grip, having a texture different than a texture of the body, extending around at least a portion of the body and extending over at least a portion of the traction element;

a cap attached to or integrally formed with the body; and a nozzle attached to or integrally formed with the cap, the nozzle positioned asymmetrically on the cap so that the nozzle is offset from a center of the cap.

11. The bottle of claim 10, wherein the neck region is tapered.

12. The bottle of claim 11, wherein the neck region includes a cavity defined by a lip and a knob.

13. The bottle of claim 10, wherein the traction element includes an indentation formed in the body.

14. The bottle of claim 10, wherein the grip includes rubber.

15. The water bottle of claim 10, wherein the neck region defines an angle that is greater than 90°.

16. The water bottle of claim 10, wherein the nozzle is positioned closer to a first edge of the cap relative to a second edge of the cap, the first edge positioned opposite of the second edge.

17. A container for dispensing fluid, comprising:

a body for containing fluid, the body including a grip having a texture different than a texture of the body, a fraction element, the grip extending around at least a portion of the body and extending over at least a portion of the traction element, a lip on the body, a knob on the body, and a cavity formed in the neck region only and defined by the lip and the knob, the remainder of the body proximate the neck region being free of cavities, the lip and the cavity extend only partially around the bottle;

a tapered cap angled away from the container; and a nozzle positioned asymmetrically between a first edge and a second edge of the tapered cap.

* * * * *